US006651796B2

(12) United States Patent
Chou

(10) Patent No.: US 6,651,796 B2
(45) Date of Patent: Nov. 25, 2003

(54) PAPER CURRENCY RECEIVING SYSTEM MOUNTING ARRANGEMENT FOR AN AUTOMATIC VENDING MACHINE

(75) Inventor: Shang-Ter Chou, Taoyuan (TW)

(73) Assignee: International Currency Technologies Corporation, Taipei (TW)

( * ) Notice: Subject to any disclaimer, the term of this patent is extended or adjusted under 35 U.S.C. 154(b) by 133 days.

(21) Appl. No.: 10/014,539

(22) Filed: Dec. 14, 2001

(65) Prior Publication Data

US 2003/0111317 A1 Jun. 19, 2003

(51) Int. Cl.[7] ..... G07D 9/00
(52) U.S. Cl. ..... 194/350
(58) Field of Search ..... 194/206, 207, 194/350; 271/181, 180, 177; 221/198; 209/534; 902/12, 13

(56) References Cited

U.S. PATENT DOCUMENTS 5,653,436 A * 8/1997 Zouzoulas ..... 271/177
6,138,814 A * 10/2000 Miller et al. ..... 194/350

* cited by examiner

*Primary Examiner*—F. J. Bartuska
(74) *Attorney, Agent, or Firm*—Bacon & Thomas, PLLC

(57) ABSTRACT

A paper currency receiving system mounting arrangement includes a housing defining an upper open chamber and a lower open chamber, a paper currency transferring unit inserted into the upper open chamber, the paper currency transferring unit having two spring plates, which are forced into engagement with respective retaining holes of the housing to lock the paper currency transferring unit after insertion of the paper currency transferring unit into the upper open chamber, a paper currency receiving cabinet detachably inserted into the lower open chamber, and a locking structure adapted for locking the paper currency receiving cabinet, the locking structure including two stub rods fixedly bilaterally provided at the paper currency receiving cabinet, two spring-supported locking plates pivoted to the housing at two sides and adapted for hooking the stub rods to lock the paper currency receiving cabinet, and two push bars adapted for moving the locking plates from the locking position to the unlocking position.

2 Claims, 6 Drawing Sheets

PAPER CURRENCY RECEIVING SYSTEM MOUNTING ARRANGEMENT FOR AN AUTOMATIC VENDING MACHINE

BACKGROUND OF THE INVENTION

1. Field of the Invention

The present invention relates to an automatic vending machine and, more specifically to a paper currency receiving system mounting arrangement for an automatic vending machine, which can easily detachably assembled.

2. Description of the Related Art

A variety of ticket vending machines have been disclosed, and intensively used in parking lots, stations, public facilities for receiving paper currency and vending tickets. A regular ticket vending machine is generally comprised of a paper currency take-up unit adapted for taking up inserted paper currency, a paper currency verification unit adapted for verifying the authenticity of inserted paper currency, and a paper currency storage cabinet adapted for collecting verified paper currency. These three units are fixedly fastened together by screws. When removing the paper currency storage cabinet from the paper currency take-up unit for picking up collected paper currency, the worker must use a screwdriver to unfasten the respective screws. After collection of paper currency, the worker must attach the paper currency storage cabinet to the paper currency take-up unit and then fasten up the respective screws to fixedly secure the paper currency storage cabinet and the paper currency take-up unit again. It is complicated and time-consuming to load and unload the paper currency storage cabinet.

SUMMARY OF THE INVENTION

The present invention has been accomplished to provide a paper currency receiving system mounting arrangement, which eliminates the aforesaid drawbacks. According to one aspect of the present invention, the paper currency receiving system mounting arrangement comprises a housing defining an upper open chamber and a lower open chamber, a paper currency transferring unit inserted into the upper open chamber, a paper currency receiving cabinet detachably inserted into the lower open chamber, and a locking structure adapted for locking the paper currency receiving cabinet. The locking structure comprises two stub rods fixedly bilaterally provided at the paper currency receiving cabinet, two spring-supported locking plates bilaterally pivoted to the inside of the housing and adapted for hooking the stub rods to lock the paper currency receiving cabinet, and two push bars adapted for moving the locking plates from the locking position to the unlocking position. According to another aspect of the present invention, the housing has two retaining holes at two sides of the upper open chamber, and the paper currency transferring unit comprises two spring plates, which are respectively forced into engagement with the retaining holes of the housing to lock the paper currency transferring unit after insertion of the paper currency transferring unit into the upper open chamber.

DETAILED DESCRIPTION OF THE PREFERRED EMBODIMENT

Figure 1:
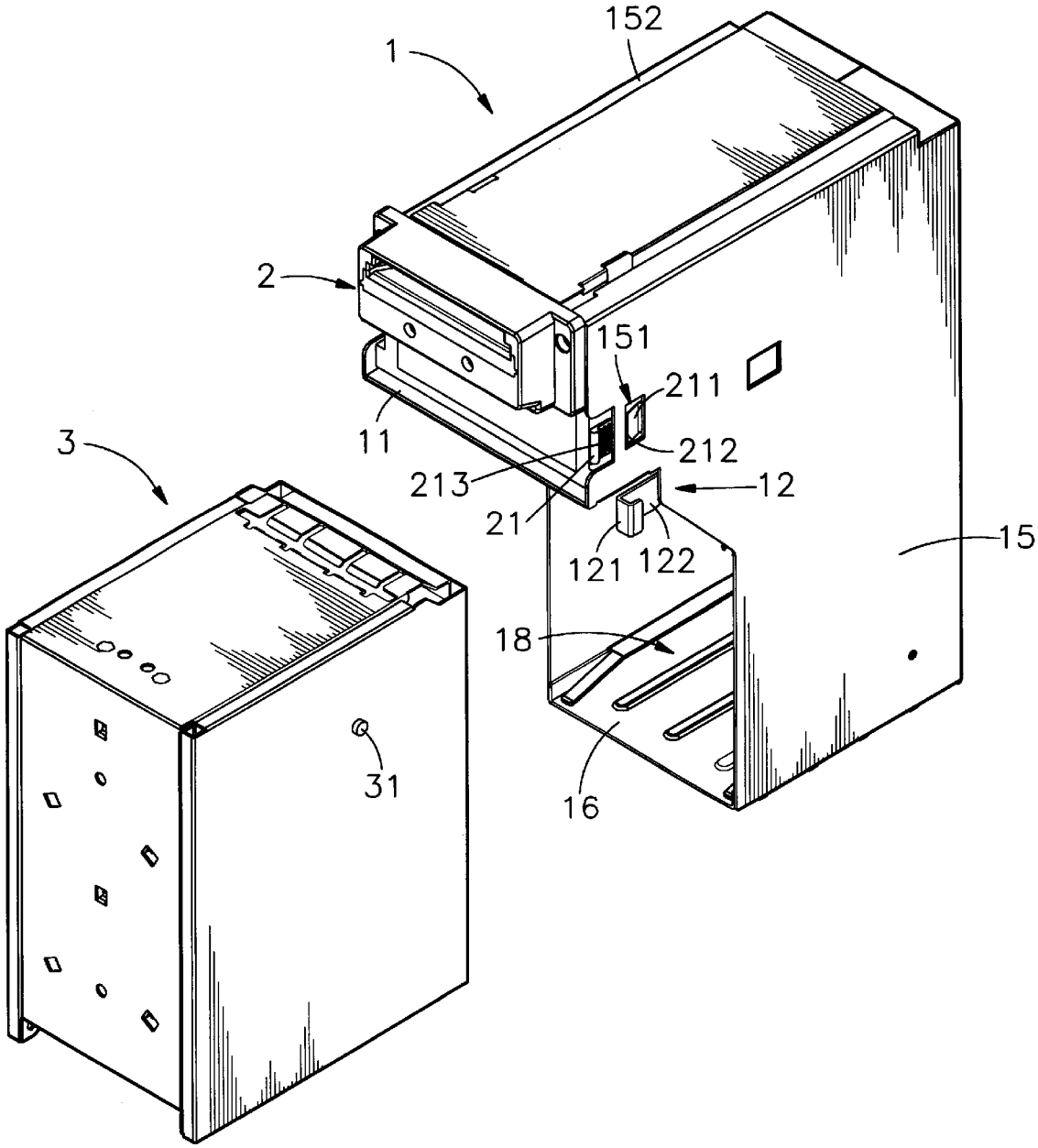
FIG. 1 is an elevational view of a paper currency receiving system mounting arrangement constructed according to the present invention before insertion of the paper currency receiving cabinet in the housing.
Figure 2:
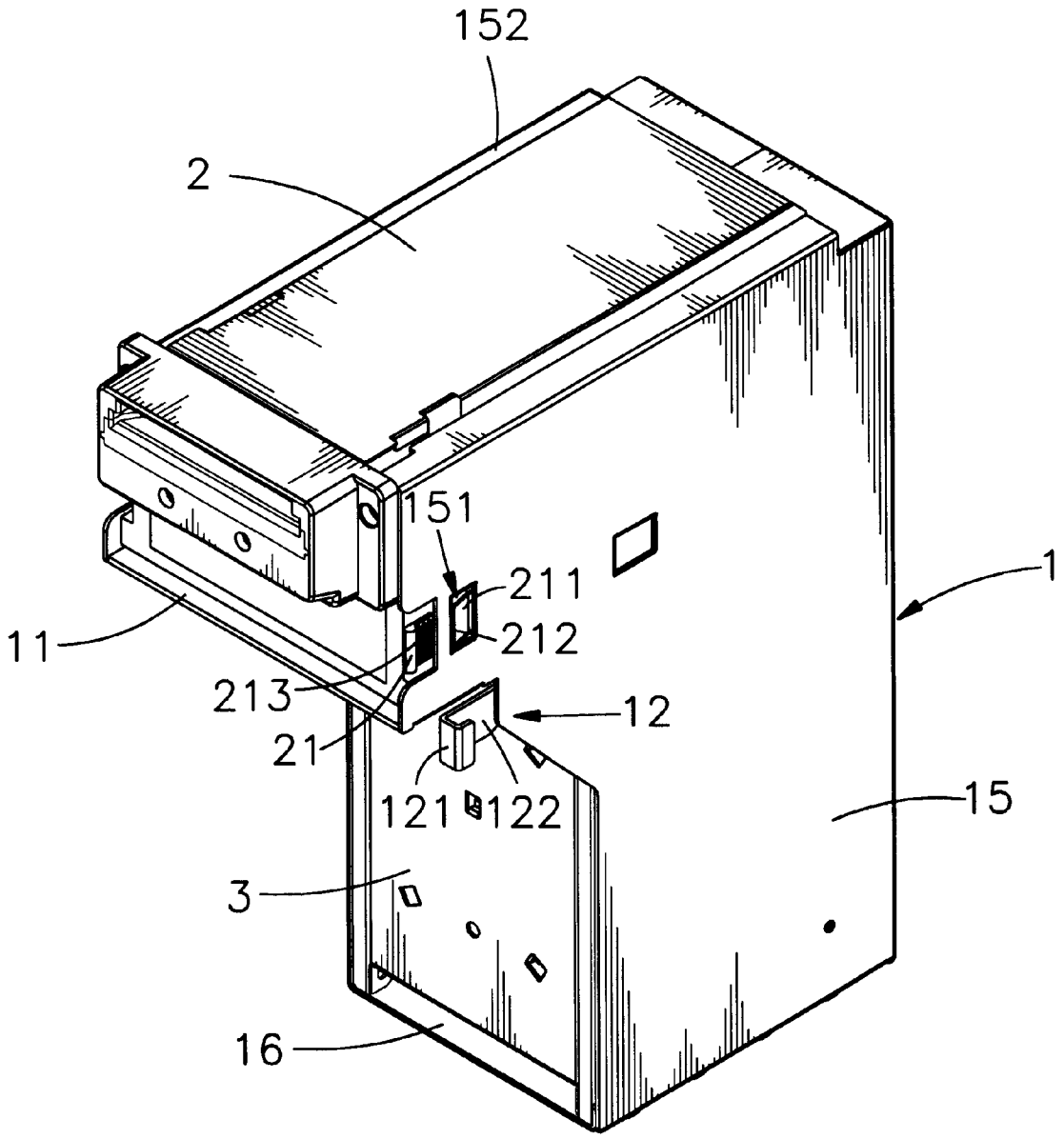
FIG. 2 is an elevational view of the paper currency receiving system mounting arrangement after insertion of the paper currency receiving cabinet in the housing according to the present invention.
Figure 3:
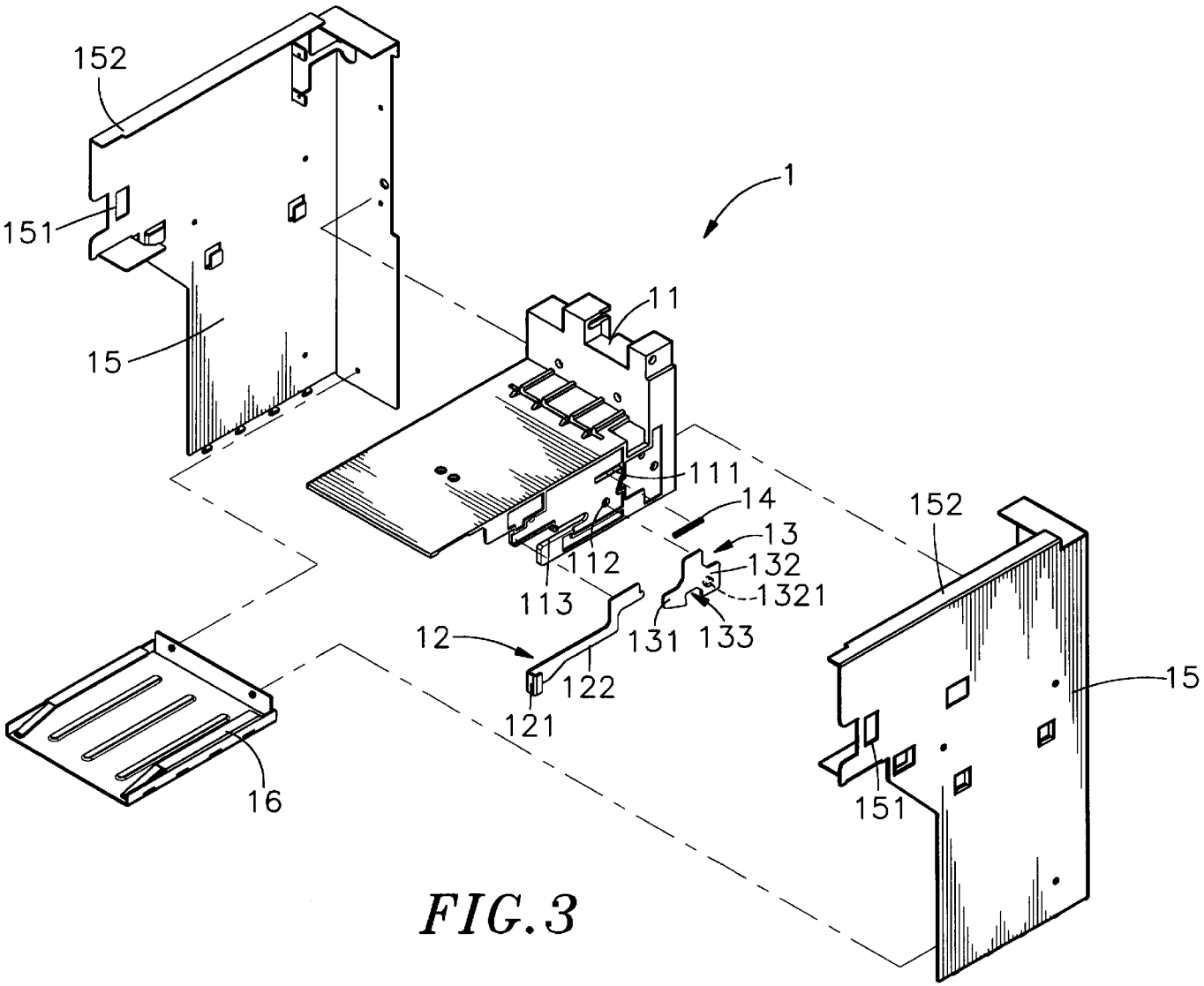
FIG. 3 is an exploded view of the housing for the paper currency receiving system mounting arrangement according to the present invention.
Figure 4:
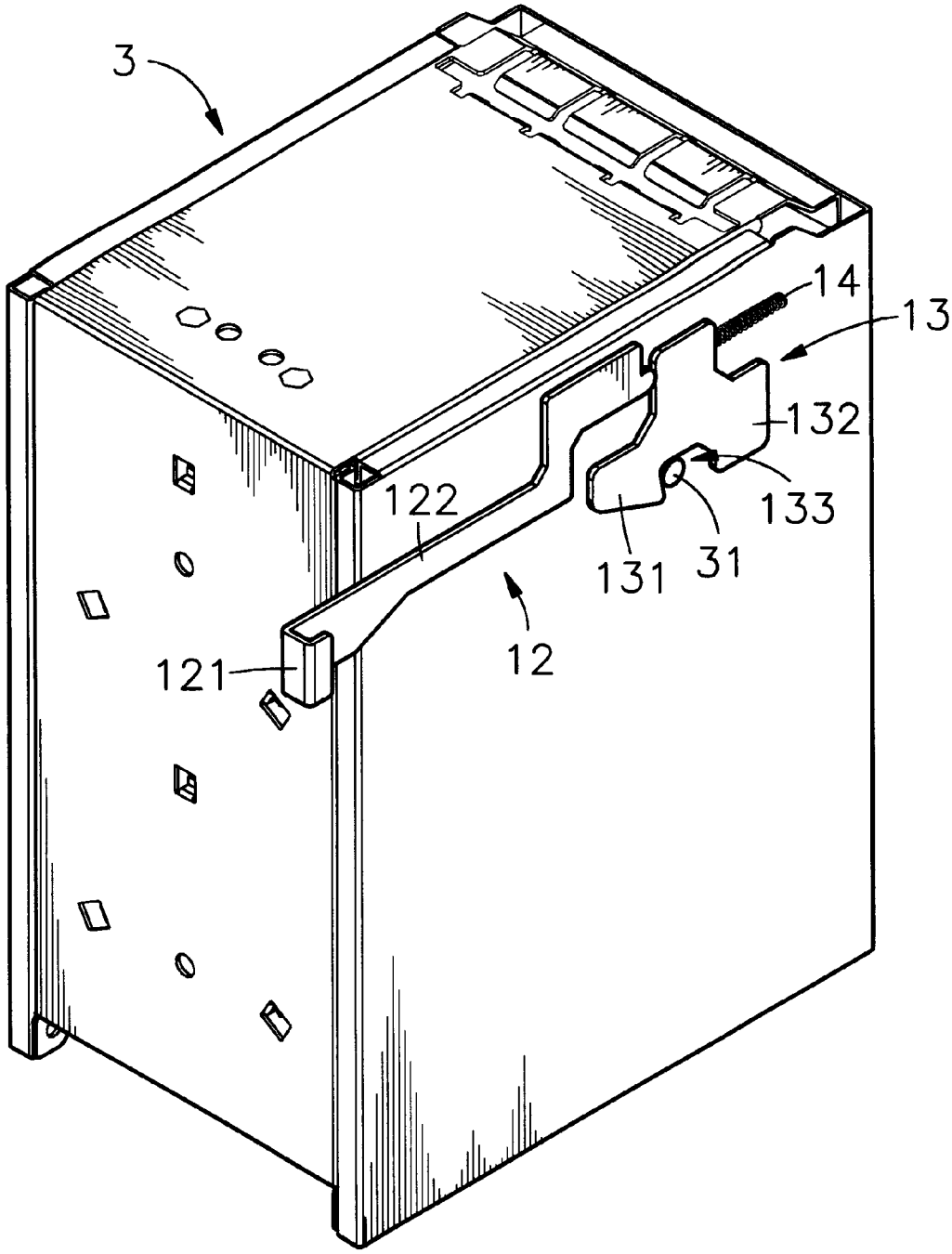
FIG. 4 is an elevational view of a part of the present invention, showing the locking plate engaged with the corresponding stub rod of the paper currency receiving cabinet.
Figure 5:
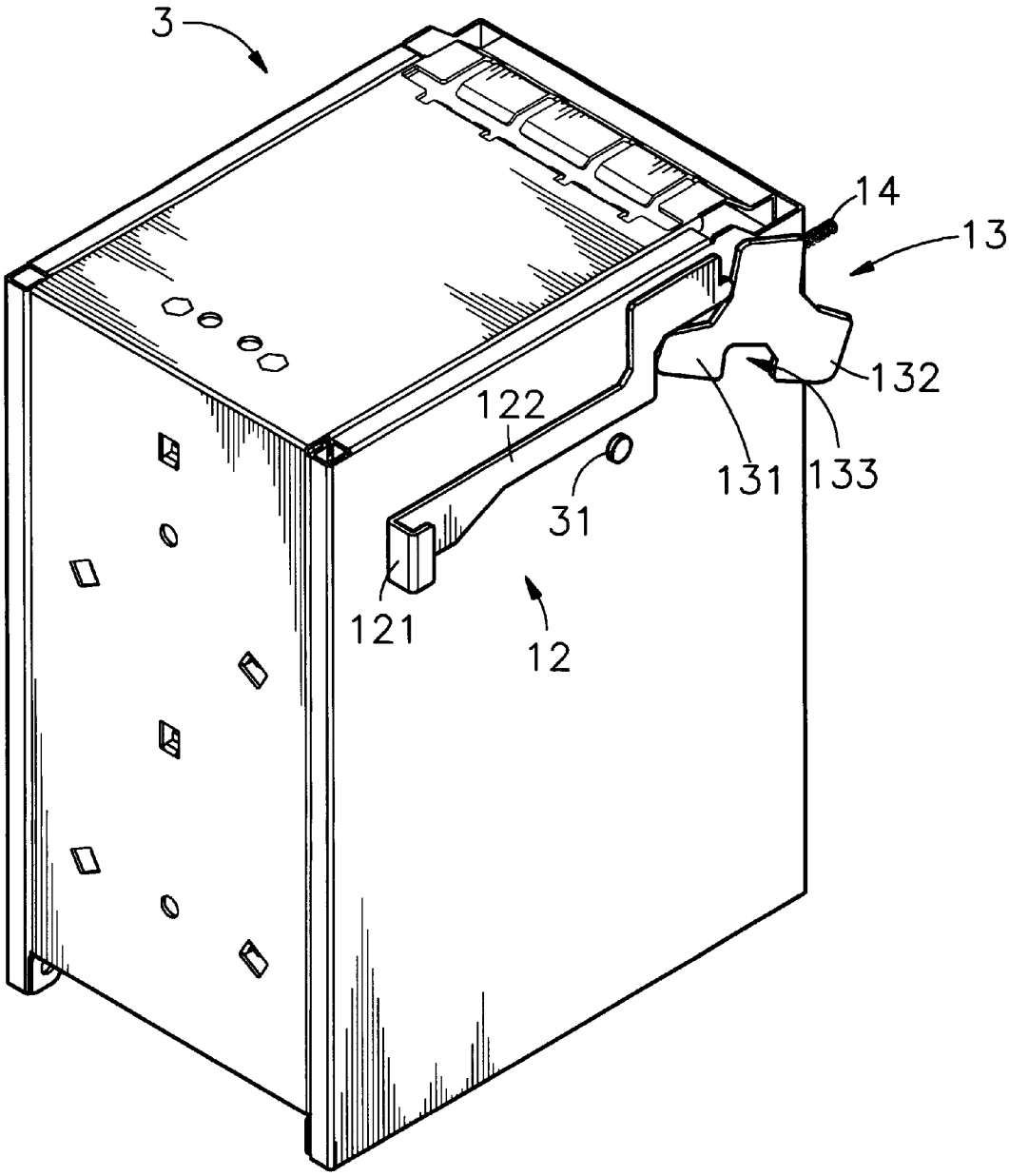
FIG. 5 is similar to FIG. 4 but showing the locking plate disengaged from the corresponding stub rod of the paper currency receiving cabinet.

Referring to FIGS. 1, 2, and 3, a paper currency receiving system mounting arrangement in accordance with the present invention is generally comprised of a housing 1, a paper currency transferring unit 2, and a paper currency collection cabinet 3.

Figure 6:
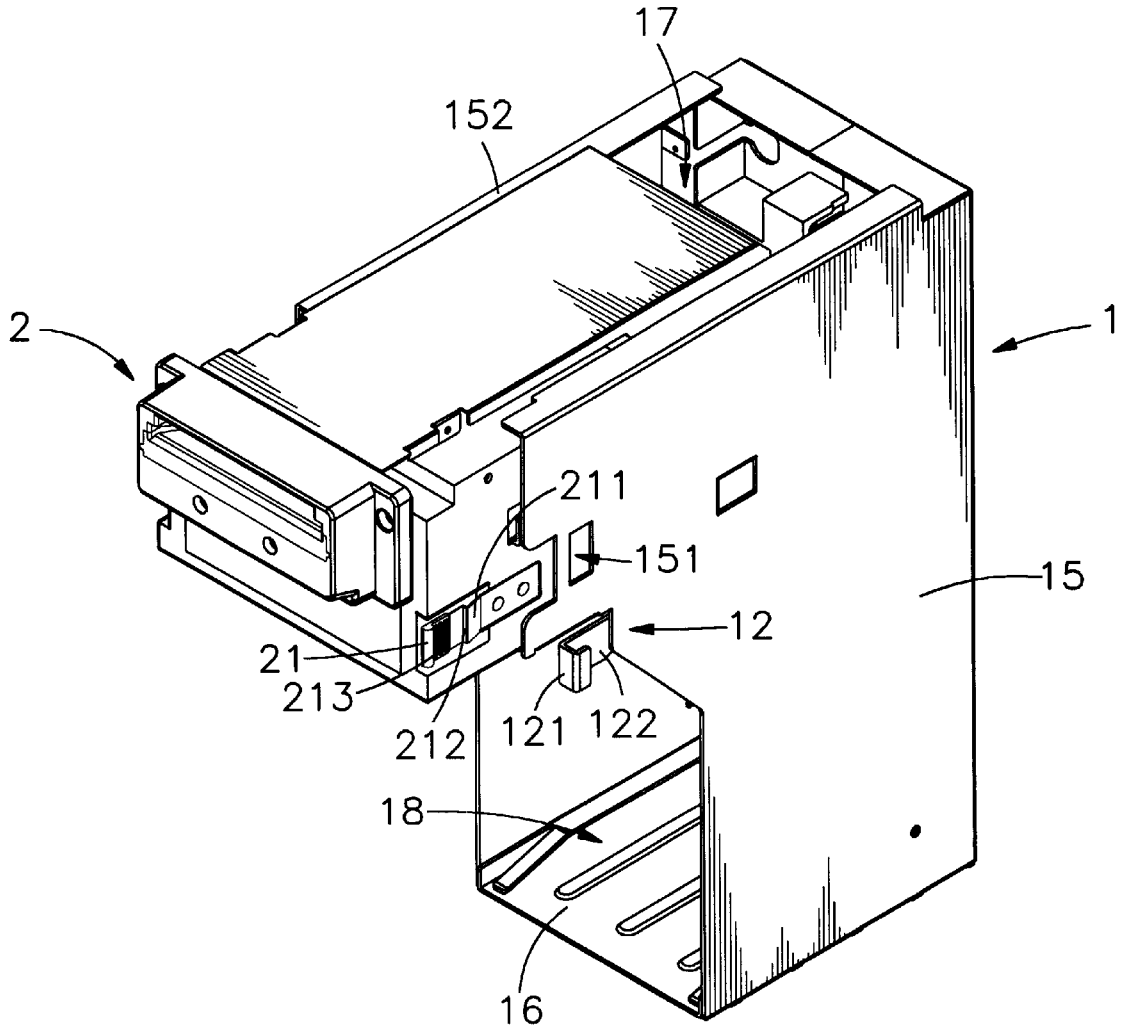
FIG. 6 is an elevational view of a part of the present invention, showing the paper currency transferring unit inserted into the upper chamber of the housing according to the present invention.

The housing 1 comprises two opposite side panels 15, a bottom panel 16, and a partition block 11 mounted in between the side panels 15. The partition block 11 divides the holding space of the housing 1 into an upper open chamber 17 (see FIG. 6) and a lower open chamber 18. The partition block 11 comprises at each of the two opposite lateral sides thereof, a slot 111, a pivot hole 112, and a track 113, and receives a push bar 12, a locking plate 13, and a spring 14 at each of the two opposite lateral sides. The push bar 12 comprises an elongated body 122 coupled to the locking plate 13, and a front finger strip 121 at one end of the elongated body 122 remote from the locking plate 13. The locking plate 13 comprises a hooked head 131, a tail 132, a retaining notch 133 on the middle between the hooked head 131 and the tail 132, and a pivot pin 1321 protruded from one side of the tail 132 and pivoted to the pivot hole 112. The spring 14 is connected between the locking plate 13 and the slot 111 and adapted for returning the locking plate 13 after the locking plate 13 being rotated. The side panels 15 each have a retaining hole 151, and an inwardly protruded top flange 152. The paper currency transferring unit 2 comprises two spring plates 21 respectively disposed at two opposite lateral sides. The spring plates 21 each comprise a rear guide face 211, a middle retaining portion 212, and a front finger strip 213. The paper currency collection cabinet 3 comprises two stub rods 31 respectively protruded from the two opposite lateral sidewalls thereof.

The assembly process of the present invention is simple, and outlined hereinafter with reference to FIGS. 1, 2, 4, and 6. The paper currency transferring unit 2 is inserted into the upper chamber 17 of the housing 1 to force the retaining portions 212 of the spring plates 21 into engagement with the retaining holes 151 of the side panels 15 of the housing 1. By means of the guiding of the guide faces 211 of the spring plates 21, the paper currency transferring unit 2 can easily be inserted into position in the housing 1. When pulling the finger strips 213 of the spring plates 21 sideways, the spring plates 21 are deformed to disengage the retaining portions 212 from the retaining holes 151, enabling the paper currency transferring unit 2 to be easily taken away from the housing 1. When inserting the paper currency collection cabinet 3 into the lower chamber 18 of the housing 1, the stub rods 31 of the paper currency collection cabinet 3 are forced into the tracks 113 at two sides of the partition block 11 and respectively moved against the beveled bottom side edges of the hooked heads 131 of the locking plates 13 to turn the locking plates 13 upwards, thereby causing the stud rods 31 to be respectively forced into engagement with the retaining notches 133 of the locking plates 13, and therefore the paper currency receiving cabinet 3 is locked in the lower receiving chamber 18 (see FIG. 2).

Referring to FIGS. 1, 2, 4, and 5, when pushing the front finger strips 121 of the push bars 12 backwards to force the elongated bodies 122 against the locking plates 13 respectively, the locking plates 13 are rotated clockwise and disengaged from the stub rods 31 of the paper currency receiving cabinet 3, for enabling the paper currency receiving cabinet 3 to be taken away from the housing 1. After release of the hands from the finger strips 121 of the push bars 12, the springs 14 immediately return the locking plates 13 to their former position.

A prototype of paper currency receiving system mounting arrangement has been constructed with the features of the annexed drawings of FIGS. 1~6. The paper currency receiving system mounting arrangement functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A paper currency receiving system mounting arrangement comprising a housing, said housing comprising an upper open chamber, a lower open chamber, a partition block separating said upper open chamber and said lower open chamber, a paper currency receiving cabinet detachably inserted into the lower open chamber of said housing, and a paper currency transferring unit detachably inserted into said upper open chamber of said housing, and a locking structure adapted for locking said paper currency receiving cabinet in said lower open chamber, wherein said locking structure comprises two stub rods respectively formed integral with two opposite lateral sidewalls of said paper currency receiving cabinet, locking plates respectively pivoted to two opposite lateral sidewalls of said partition block and rotated between the locking position where said locking plates are respectively hooked on the stub rods of said paper currency receiving cabinet to lock said paper currency receiving cabinet in said lower open chamber and the unlocking position where said locking plates are respectively disengaged from the stub rods of said paper currency receiving cabinet for enabling said paper currency receiving cabinet to be taken away from said housing, two spring members respectively connected between said locking plates and the two opposite lateral sidewalls of said partition block to hold said locking plates in the locking position, and two push bars respectively coupled to the two opposite lateral sidewalls of said partition block for operation by hand to turn said locking plates from the locking position to the unlocking position.

2. The paper currency receiving system mounting arrangement as claimed in claim 1, wherein said housing comprises two retaining holes disposed at two sides of said upper open chamber, and said paper currency transferring unit comprises two spring plates fixedly provided at two opposite lateral sidewalls thereof and adapted for engaging the retaining holes of said housing to lock said paper currency transferring unit after insertion of said paper currency transferring unit into said upper open chamber, said spring plates each comprising a guide face adapted for guiding said paper currency receiving unit into said upper open chamber, a protruded retaining portion adapted for engaging the retaining holes of said housing, and a finger strip adapted for operation by hand to disengage the respective protruded retaining portion from the corresponding retaining hole of said housing.

* * * * *